US007501387B2

(12) United States Patent
Aihara et al.

(10) Patent No.: US 7,501,387 B2
(45) Date of Patent: Mar. 10, 2009

(54) ANTIFOULING DETERGENT FOR HARD SURFACES

(75) Inventors: Shin Aihara, Wakayama (JP); Yosuke Komatsu, Wakayama (JP); Kazunori Tsukuda, Wakayama (JP); Seiichi Miyanaga, Wakayama (JP); Kenichi Shiba, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/500,469

(22) PCT Filed: Feb. 21, 2003

(86) PCT No.: PCT/JP03/01939

§ 371 (c)(1),
(2), (4) Date: Jul. 15, 2004

(87) PCT Pub. No.: WO03/070866

PCT Pub. Date: Aug. 28, 2003

(65) Prior Publication Data

US 2005/0070456 A1 Mar. 31, 2005

(30) Foreign Application Priority Data

Feb. 22, 2002 (JP) ..... 2002-046121

(51) Int. Cl.

| | |
|---|---|
| ***C11D 1/00*** | (2006.01) |
| ***C11D 3/26*** | (2006.01) |
| ***C11D 3/37*** | (2006.01) |
| ***B08B 3/04*** | (2006.01) |

(52) U.S. Cl. ..... 510/191; 510/238; 510/477; 510/504; 134/39; 134/42

(58) Field of Classification Search ..... None
See application file for complete search history.

(56) References Cited

U.S. PATENT DOCUMENTS

| | | | | |
|---|---|---|---|---|
| 5,308,532 | A | 5/1994 | Adler et al. | |
| 5,872,088 | A * | 2/1999 | Pucci et al. | 510/238 |
| 6,083,890 | A * | 7/2000 | Miskiel et al. | 510/108 |
| 6,251,849 | B1 | 6/2001 | Kade et al. | |
| 6,593,288 | B2 * | 7/2003 | Aubay et al. | 510/504 |
| 6,701,940 | B2 * | 3/2004 | Tsibouklis et al. | 134/25.2 |
| 6,703,358 | B1 * | 3/2004 | Aubay et al. | 510/434 |

FOREIGN PATENT DOCUMENTS

| | | |
|---|---|---|
| DE | 100 62 355 | 6/2001 |
| EP | 342 997 | 11/1989 |
| EP | 467 472 | 1/1992 |
| JP | 7-102299 | 4/1995 |
| JP | 9-169995 | 6/1997 |
| JP | 2001-181353 | 7/2001 |
| JP | 2001-271094 | 10/2001 |
| WO | WO 01/05921 A1 | 1/2001 |
| WO | 02/16536 | 2/2002 |

OTHER PUBLICATIONS

Translation; JP 2001-271094; Oct. 2, 2001.*
U.S. Appl. No. 10/500,469, filed Jul. 15, 2004, Aihara, et al.
U.S. Appl. No. 10/500,859, filed Jul. 19, 2004, Aihara, et al.

* cited by examiner

*Primary Examiner*—Gregory R Del Cotto
(74) *Attorney, Agent, or Firm*—Oblon, Spivak, McClelland, Maier & Neustadt, P.C.

(57) ABSTRACT

An antifouling detergent for hard surfaces, which can be used in home to confer an excellent antifouling performance and an ability to prevent re-deposition on hard surfaces in a toilet, a bathroom and a kitchen; and a method of antifouling and washing hard surfaces of toilet bowls, which includes treating the surfaces with an antifouling detergent composition.

5 Claims, No Drawings

ANTIFOULING DETERGENT FOR HARD SURFACES

TECHNICAL FIELD

This invention relates to a detergent which has a soil-preventing effect (hereinafter "an antifouling detergent") for hard surfaces, which has antifouling performance capable of preventing fouling and easily removing fouling on hard surfaces and in particular to an antifouling detergent for hard surfaces, which can be used generally in a house, particularly in a wall, floor, instruments and devices in a kitchen, a bathroom, a toilet and a washstand, especially inside a toilet bowl in order to prevent fouling and to easily remove fouling.

BACKGROUND ART

Surfaces of various living articles can be easily stained harmfully by fouling, for example, soils, deposition, dirt and so on. To remove fouling, various detergents have been developed and examined to enhance their detergency. By these efforts, many means have been proposed in order to remove hard fouling.

While detergents excellent in removability of fouling have been developed, there are a large number of developed techniques such as techniques of preventing fouling and techniques of facilitating removal of fouling by treatment (hereinafter referred to as antifouling techniques), and techniques applied as detergents have been found. For example, JP-A 2001-181353, JP-A 2001-271094 and JP-A 2001-181601 disclose an antifouling detergent using amphoteric polymers compound having a molecular weight of 1000 to 1,000,000 prepared from an anionic vinyl monomer and dialkylaminoalkyl (meth) acrylate or dialkylaminoalkyl (meth) acrylamide. JP-A 9-169995 discloses a toilet bowl antifouling detergent lowering a surface tension inside a toilet bowl and exhibiting an antifouling effect by using, as antifouling base materials, an anionic surfactant with a cationic polymer compound or a cationic surfactant such as dimethyldiallylammonium chloride homopolymer having a molecular weight of 100,000 to 1,000,000, dimethyldiallylammonium chloride/acrylamide copolymer having a molecular weight of 1,000,000 to 10,000,000 or dimethyldiallylammonium chloride/acrylic acid copolymer having a molecular weight of 1,700,000. Further, JP-A 7-102299 discloses a foaming type of toilet bowl detergent comprising dimethyldiallylammonium chloride/acrylamide copolymer having a molecular weight of 500,000, together with a mineral acid, a monoalkylquaternaryammonium salt and a nonionic surfactant.

Further, EP-A 342997 discloses a multipurpose detergent composition comprising a nonionic surfactant, a bactericidal cationic surfactant and a non-anionic polymer capable of adsorption onto hard surfaces and as such non-anionic polymers poly(dimethyldiallylammonium chloride) (trade name: Merquat 100 (ex Merck)) and other polymers are disclosed. EP-A 467472 discloses a liquid detergent composition using an antifouling polymer for hard surfaces and a cationic quaternary polymethacrylate, for example a polymer having a beta-(trialkylammonium) alkyl methacrylate unit with a molecular weight of 5,000 to 50,000, is mentioned.

WO-A 2002/16536, published on Feb. 28, 2002, discloses an antifouling detergent for hard surfaces, which comprises a polymer having a weight-average molecular weight of 1,000 to 6,000,000, in the molecule thereof, the monomer unit having at least one substituent group selected from amino groups and quaternary ammonium groups.

In the techniques disclosed in these publications, polymer compounds having cationic groups are adsorbed onto hard surfaces to exhibit their antifouling effect, and they exhibit an excellent antifouling effect at an initial stage. However, it was found that during repeated use for a long term, there occurs the phenomenon of so-called re-deposition wherein hard surfaces are easily fouled adversely, and there is demand for solving this problem.

DISCLOSURE OF THE INVENTION

The object of this invention is to provide an antifouling detergent for hard surfaces, which can be used in a home to give excellent antifouling performance in washing of hard surfaces in a toilet, a bathroom and a kitchen without causing re-deposition even in repeated use.

This invention relates to an antifouling detergent for hard surfaces, comprising a polymer having a weight-average molecular weight of 1,000 to 80,000 and having a monomer unit derived from at least one member selected from a compound represented by the formula (1) below and a compound represented by the formula (2) below in an amount of 10 to 100 mol-% relative to the whole monomer units,

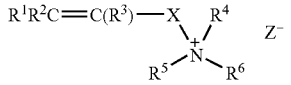

(1)

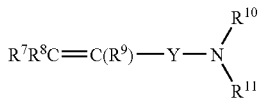

(2)

wherein $R^1$, $R^2$, $R^3$, $R^7$, $R^8$ and $R^9$ each represent a hydrogen atom, a hydroxyl group or a $C_{1-3}$ alkyl group; each of X and Y is a group selected from a $C_{1-12}$alkylene group, —$COOR^{12}$—, —$CONHR^{12}$—, —$OCOR^{12}$— and —$R^{13}$—OCO—$R^{12}$— whereupon $R^{12}$ and $R^{13}$ each represent a $C_{1-5}$ alkylene group; $R^4$ represents a $C_{1-3}$ alkyl group, a $C_{1-3}$ hydroxyalkyl group or $R^1R^2C{=}C(R^3)$—X—; $R^5$ represents a $C_{1-3}$ alkyl group, a $C_{1-3}$ hydroxyalkyl group or a benzyl group; $R^6$ represents a $C_{1-10}$ alkyl group which may be substituted with a hydroxy group, a carboxyl group, a sulfonate group or a sulfate group, or a benzyl group, provided that when $R^6$ is an alkyl group, a hydroxyalkyl group or a benzyl group, $Z^-$ represents an anion and when $R^6$ contains a carboxyl group, a sulfonate group or a sulfate group, $Z^-$ is absent, but these groups of $R^6$ are anions; $R^{10}$ represents a hydrogen atom, a $C_{1-3}$ alkyl group, a $C_{1-3}$ hydroxyalkyl group or $R^7R^8C{=}C(R^9)$—Y—; and $R^{11}$ represents a hydrogen atom, a $C_{1-3}$ alkyl group or a $C_{1-3}$ hydroxyalkyl group.

The polymer has a monomer unit having at least one group selected from amino groups and quaternary ammonium groups in molecule.

Further, this invention provides a composition as an antifouling detergent for hard surfaces, comprising the above-described polymer (a) and surfactant (b).

This invention also provides an antifouling and washing method for hard surfaces, which comprises treating hard surfaces with the above-described polymer or the above-described composition, as well as use of the above-described polymer or the above-described composition as an antifouling detergent for hard surfaces. The hard surfaces are those of toilet bowl, and this invention is effective for surfaces particularly inside toilet bowl.

In addition to the antifouling effect, this invention can prevent re-deposition. Repeated washing can be carried out for a long term.

DETAILED DESCRIPTION OF THE INVENTION

The component (a) used in this invention is a polymer containing a monomer unit (hereinafter referred to as monomer unit A) derived from a monomer which represented by the formula (1) or (2) mentioned below and having a weight-average molecular weight of 1,000 to 80,000, preferably 2,000 to 80,000, more preferably 5,000 to 60,000. If the weight-average molecular weight is below the range of this invention, a satisfactory antifouling effect cannot be achieved, while if the molecular weight exceeds the range of this invention, re-deposition occurs easily after repeated use so that while the antifouling detergent exhibits an excellent antifouling effect at an initial stage, fouling easily occurs after repeated use. This fouling phenomena is significant particularly in toilet bowl. When the polymer has a high molecular weight, the polymer is deposited on hard surfaces interacting with soil, which may adversely facilitate fouling. The weight-average molecular weight is determined by gel permeation chromatography using polyethylene glycol as standards with a mixed solvent of acetonitrile and water (phosphate buffer) as an eluent.

The monomer used for constituting the monomer unit A is at least one member selected from a compound of the formula (1) below and a compound of the formula (2) below.

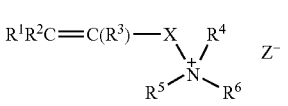

(1)

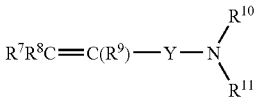

(2)

wherein $R^1$, $R^2$, $R^3$, $R^7$, $R^8$ and $R^9$ each represent a hydrogen atom, a hydroxyl group or a $C_{1-3}$ alkyl group; each of X and Y is a group selected from a $C_{1-12}$ alkylene group, —$COOR^{12}$—, —$CONHR^{12}$—, —$OCOR^{12}$— and —$R^{13}$—OCO—$R^{12}$— whereupon $R^{12}$ and $R^{13}$ each represent a $C_{1-5}$ alkylene group; $R^4$ represents a $C_{1-3}$ alkyl group, a $C_{1-3}$ hydroxyalkyl group or $R^1R^2C{=}C(R^3)$—X—; $R^5$ represents a $C_{1-3}$ alkyl group, a $C_{1-3}$ hydroxyalkyl group or a benzyl group; $R^6$ represents a $C_{1-10}$ alkyl group which may be substituted with a hydroxy group, a carboxyl group, a sulfonate group or a sulfate group, or a benzyl group, provided that when $R^6$ is an alkyl group, a hydroxyalkyl group or a benzyl group, $Z^-$ represents an anion and when $R^6$ contains a carboxyl group, a sulfonate group or a sulfate group, $Z^-$ is absent, but these groups of $R^6$ are anions; the anion represented by $Z^-$ includes, for example, a halogen ion, a sulfate ion, a $C_{1-3}$ alkyl sulfate ion, an aromatic sulfonate ion which may be substituted with a $C_{1-3}$ alkyl group, and a hydroxy ion; $R^{10}$ represents a hydrogen atom, a $C_{1-3}$ alkyl group, a $C_{1-3}$ hydroxyalkyl group or $R^7R^8C{=}C(R^9)$—Y—; and $R^{11}$ represents a hydrogen atom, a $C_{1-3}$ alkyl group or a $C_{1-3}$ hydroxyalkyl group.

Specifically, the compound of the formula (1) is preferably (ω-acryloylamino (or methacryloylamino)alkyl (C1 to C5)) trialkyl(C1 to C3)ammonium salt, acryloyloxy(or methacryloyloxy)alkyl(C1 to C5)trialkyl(C1 to C3)ammonium salt, (ω-alkenyl(C2 to C10))trialkyl(C1 to C3)ammonium salt,di (ω-alkenyl (C2 to C10))dialkyl (C1 to C3)ammonium salt, particularly preferably a diallyldimethylammonium salt.

Specifically, the compound of the formula (2) is preferably dialkyl(C1 to C3)aminoalkyl(C1 to C5)acrylamid(or methacryloylamide), dialkyl(C1 to C3)aminoalkyl(C1 to C5) acrylate(or methacrylate), N—(ω-alkenyl(C2 to C10))-N,N-dialkyl (C1 to C3)amine, N,N-di(ω-alkenyl(C2 to C10)) amine, N,N-di(ω-alkenyl(C2 to C10))-N-alkyl(C1 to C3)amine, allylamine, diallylmethylamine or diallylamine, particularly preferably allylamine, diallylmethylamine, diallylamine, dimethylaminopropylacrylamide (or methacrylamide) or dimethylaminoethyl acrylate (or methacrylate). The monomer unit A is contained in a ratio of 10-100 mol-%, preferably 20-100 mol-%, more preferably 30-90 mol-%, to the whole monomers.

The component (a) in this invention may be either a polymer comprising only the monomer unit A (which may be plural kinds of monomers) or a copolymer comprising the monomer unit A (which may be plural kinds of monomers) and another monomer unit (hereinafter referred to as monomer unit B). In the later case, the monomer units A and monomer units B (which may be plural kinds of monomers) may be arranged either in a block, alternating, periodic, statistical (including random) or a graft manner.

The copolymer consisting of the monomer unit A and monomer unit B can be obtained, for example, by copolymerizing their corresponding monomers, respectively. In this case, the monomer unit B is preferably a monomer unit derived from a monomer selected from the monomer groups (i) to (v) below, more preferably a monomer unit derived from a monomer described in (i) to (iii) or (v), still more preferably a monomer unit derived from a monomer in (i), (ii) or (v) in respect of the antifouling effect, most preferably a monomer unit derived from a monomer in (i), among which acrylic acid or sodium or potassium salts thereof, methacrylic acid or sodium or potassium salts thereof, and maleic acid or sodium or potassium salts thereof are preferable. Here, a counterion for the monomer unit derived from a monomer in (i) may be a cationic-group moiety of the polymer containing the counterion. A monomer unit derived from a monomer in (v) is preferably used to prevent corrosion of metal materials, and a copolymer containing monomer units derived from monomers in (i) and (v) is particularly preferable because this copolymer meets both antifouling performance and prevention of corrosion.

(i) An anionic group-containing compound selected from acrylic acid or salts thereof, methacrylic acid or salts thereof, maleic acid or salts thereof, maleic anhydride, styrene sulfonate, 2-acrylamido-2-methylpropanesulfonic acid or salts thereof, allyl sulfonate, vinyl sulfonate, methallyl sulfonate, sulfopropyl methacrylate and mono-ω-methacryloyloxyalkyl(C1 to 12) phosphate.

(ii) An amide group-containing compound selected from acryl(or methacryl)amide, N,N-dimethylaminopropylacryl (or methacryl)amide, N,N-dimethylacryl(or methacryl) amide, N,N-dimethylaminoethylacryl (or methacryl)amide, N,N-dimethylaminomethylacryl (or methacryl)amide, N-vinyl-2-caprolactam, and N-vinyl-2-pyrrolidone.

(iii) An ester group-containing compound selected from alkyl(C1 to C5) acrylate(or methacrylate), 2-hydroxyethyl acrylate(or methacrylate), N,N-dimethylaminoalkyl(C1 to 5) acrylate(or methacrylate), and vinyl acetate.

(iv) A compound selected from ethylene, propylene, n-butylene, isobutylene, n-pentene, isoprene, 2-methyl-1-butene, n-hexene, 2-methyl-1-pentene, 3-methyl-1-pentene, 4-methyl-1-pentene, 2-ethyl-1-butene, styrene, vinyl toluene, α-methyl styrene, ethylene oxide, propylene oxide, 2-vinyl pyridine and 4-vinyl pyridine.

(v) Sulfur Dioxide.

The polymer having the monomer unit A and monomer unit B may be obtained not only by the copolymerizing method described above but also by graft polymerization of the monomers in (i) to (v), particularly preferably the monomers in (i) and (ii), with a polymer containing the monomer unit A. Alternatively, the polymer may be obtained by graft polymerization of the monomers of the formula (1) and/or (2) above with a polymer containing the monomers in (i) to (v), or by graft polymerization of the monomer of the formula (2) with a polymer containing the monomers in (i) to (v), particularly a polymer containing the monomers in (i) and (ii), and then converting the resulting graft polymer into its corresponding quaternary product.

The polymer constituting the component (a) in this invention may be obtained by any kind of polymerization procedures, preferably by radical polymerization. It can be carried out in a bulk, solution or emulsion system. The radical polymerization may be initiated by heating, or alternatively by adding radical initiator, for example, an azo-type initiator such as 2,2'-azobis(2-amidinopropane) dihydrochloride and 2,2'-azobis(N,N-dimethyleneisobutylamidine) dihydrochloride, hydrogen peroxide, an organic peroxide such as benzoyl peroxide, t-butyl hydroperoxide, cumene hydroperoxide, methyl ethyl ketone peroxide and perbenzoic acid, a persulfate such as sodium persulfate, potassium persulfate and ammonium persulfate, and a redox initiator such as hydrogen peroxide-$Fe^{3+}$ may be used, or the polymerization may be initiated by photo irradiation in the presence or absence of a photosensitizer or by radiation.

The component (a) in this invention may be a mixture of polymers selected from a homopolymer of the monomer unit A and a copolymer of the monomer units A and B. As the production method, reference can be made of a method described in JP-B 53-25599.

The component (a) in this invention is more preferably the one having the monomers A and B in an amount of 50 to 100 mol-% relative to the whole monomer units, most preferably the one wherein the molar ratio of monomer unit A/[monomer unit A +monomer unit B] is 0.3 to 0.99, particularly 0.4 to 0.95, more preferably 0.5 to 0.9.

The antifouling detergent for hard surfaces in this invention may contain another water-soluble polymer in addition to the component (a) insofar as the antifouling performance is not significantly inhibited.

The component (a) is contained in an amount of preferably 0.01 to 35 mass-%, more preferably 0.02 to 25 mass-%, in the antifouling detergent for hard surfaces in this invention, and when the hard surface is washed by a spraying method of using a spray device such as a trigger or an aerosol or by a applying method, the concentration of the component (a) is 0.01 to 10 mass-%, more preferably 0.02 to 5 mass-%, still more preferably 0.05 to 2 mass-%. On the other hand, when an automatic toilet bowl cleaner that can feed a suitable amount of a detergent to water in a toilet tank by arranging the device in the tank or in an arbitrary water-feeding passage is used in a method of washing with water in a toilet tank, the component (a) is contained in an amount of 2 to 35 mass-%, more preferably 3 to 25 mass-%, still more preferably 4 to 15 mass-%. The concentration of the component (a) in the tank is preferably 0.05 to 15 ppm (ratio by mass; this applies hereinafter), more preferably 0.1 to 10 ppm.

The pH value of the antifouling detergent of this invention at 20° C. is preferably 2 to 12, more preferably 3 to 11, particularly preferably 5 to 8 for the antifouling detergent effect. As the pH adjusting agent, acidic agents, for example, inorganic acids such as hydrochloric acid and sulfuric acid, organic acids such as citric acid, succinic acid, malic acid, fumaric acid, tartaric acid, malonic acid and maleic acid, and alkali agents, for example, sodium hydroxide, potassium hydroxide, ammonia or derivatives thereof, amine compounds such as monoethanolamine, diethanolamine and triethanolamine, and sodium carbonate and potassium carbonate, can be used alone or as a mixture thereof. Further, these acid agents and alkali agents may be combined for use as a buffer system.

A surfactant (hereinafter referred to as component (b)) is contained preferably in the antifouling detergent for hard surfaces in this invention for the purpose of improving the antifouling detergent effect and for the purpose of conferring an ability to foam in improving adhesion and a feel of the detergent effect during use. As the surfactant, at least one member selected from an anionic surfactant, a nonionic surfactant, a cationic surfactant and an amphoteric surfactant is preferable.

Preferable examples of the anionic surfactant include alkylbenzenesulfonates, alkanesulfonates, α-olefin sulfonates, alkyl sulfates, polyoxyethylene (average number of molecules added: 1 to 10) alkyl ether sulfates and polyoxyethylene(average number of molecules added: 1 to 10) alkyl ether acetates, all of which have $C_{8-18}$ alkyl groups, among which alkylbenzenesulfonates having $C_{10-15}$ alkyl groups, alkyl sulfonates having $C_{8-14}$ alkyl groups, and polyoxyethylene (average number of molecules added: 1 to 5) alkyl ether sulfates having $C_{10-14}$ alkyl groups. The salts thereof are preferably sodium or potassium salts.

As the nonionic surfactant, the compound of the formula (3) below and/or the compound of the formula (4) below are preferable in respect of the antifouling detergent effect.

$$R^{14}\text{-}T\text{-}[(R^{15}O)_a\text{—}R^{16}]_b \quad (3)$$

wherein $R^{14}$ represents a $C_{8-20}$, preferably $C_{10-18}$ alkyl group or alkenyl group; $R^{15}$ represents a $C_2$ or $C_3$ alkylene group, preferably an ethylene group; $R^{16}$ represents a $C_{1-3}$ alkyl group or a hydrogen atom; a is the number of 1 to 100 on the average, preferably 3 to 80, more preferably 5 to 40, still more preferably 5 to 20; T is —O—, —COO—, —CON— or —N—, and when T is —O— or —COO—, b is 1, and when T is —CON— or —N—, b is 1 or 2.

$$R^{17}\text{—}(OR^{18})_cG_d \quad (4)$$

wherein $R^{17}$ represents a linear $C_{8-16}$, preferably $C_{10-16}$, particularly preferably $C_{10-14}$ alkyl group; $R^{18}$ represents a $C_{2-4}$ alkylene group, preferably an ethylene group or a propylene group, particularly preferably an ethylene group; G is a residue derived from a reducing sugar; c is the number of 0 to 6 on the average; and d is the number of 1 to 10 on the average, preferably 1 to 5, particularly preferably 1 to 2.

Examples of the compound of the formula (3) include the following compounds:

$$R^{14}\text{—}O\text{—}(C_2H_4O)_e\text{—}H$$

wherein $R^{14}$ has the same meaning as defined above, and e is the number of 1 to 100 on the average, preferably 5 to 20.

$$R^{14}\text{—}O\text{—}(C_2H_4O)_f\text{—}(C_3H_6O)_g\text{—}H$$

wherein $R^{14}$ has the same meaning as defined above; f and g each represent the number of 1 to 20 on the average, preferably 1 to 10; and ethylene oxide (hereinafter "EO") and propylene oxide (hereinafter "PO") may be a random or block addition product.

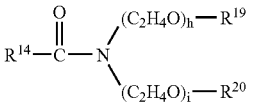

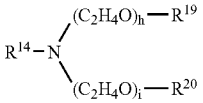

wherein $R^{14}$ has the same meaning as defined above; h and i each represent the number of 0 to 40 on the average, preferably 0 to 20; h+i is the number of 1 to 20 on the average, preferably 1 to 15; $R^{19}$ and $R^{20}$ each represent a hydrogen atom or a $C_{1-3}$ alkyl group.

In the compound of the formula (4), G is a residue derived from a reducing sugar, and the starting reducing sugar may be either aldose or ketose, and includes $C_{3-6}$ sugars such as triose, tetrose, pentose and hexose. Examples of the aldose include apiose, arabinose, galactose, glucose, lyxose, mannose, aldose, idose, talose and xylose, and the ketose includes fructose. In this invention, a $C_{5-6}$ aldopentose or an aldohexose is particularly preferable among these, and glucose is most preferable.

In respect of the antifouling detergent effect, the cationic surfactants are preferably compounds of the formulae (5) to (7):

(5)

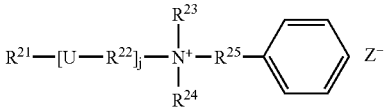

(6)

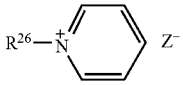

(7)

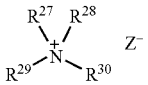

wherein $R^{21}$ represents a $C_{5-18}$, preferably $C_{6-14}$, particularly preferably $C_{8-12}$, alkyl or alkenyl group, preferably an alkyl group; $R^{23}$ and $R^{24}$ represent a $C_{1-3}$ alkyl group or a $C_{1-3}$ hydroxyalkyl group; U represents —COO—, —OCO—, —CONH—, —NHCO—, or

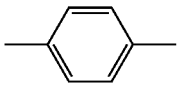

j is an integer of 0 or 1; $R^{22}$ represents a $C_{1-6}$ alkylene group or $—(O—R^{31})_k—$ whereupon $R^{31}$ represents an ethylene group or a propylene group, preferably an ethylene group, k is the number of 1 to 10 on the average, preferably 1 to 5 on the average; $R^{25}$ represents a $C_{1-5}$, preferably $C_{1-3}$, alkylene group; $R^{26}$ represents a $C_{8-16}$ alkyl group; two or more (preferably two) of $R^{27}$, $R^{28}$, $R^{29}$ and $R^{30}$ represent a $C_{8-18}$, preferably $C_{8-12}$, alkyl group while the remainder represents a $C_{1-3}$ alkyl group or a $C_{1-3}$ hydroxyalkyl group; and $Z^-$ represents an anionic group, preferably a halogen ion or a $C_{1-3}$ alkyl sulfate ion.

Among the surfactants of the formulae above, the most preferable cationic surfactant in this invention includes:

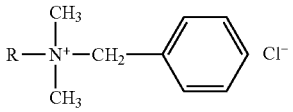

wherein R is a $C_{8-18}$, preferably $C_{8-14}$ alkyl group.

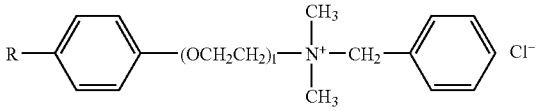

wherein R is an optionally branched $C_{6-10}$ alkyl group, and l is the number of 1 to 5 on the average.

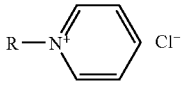

wherein R is a $C_{8-12}$ alkyl group.

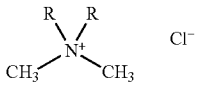

wherein R groups each represent a $C_{8-12}$ alkyl group.

The amphoteric surfactants are preferably compounds of the following formulae (8) and (9):

(8)

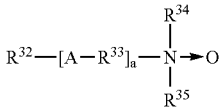

wherein $R^{32}$ represents a $C_{8-16}$, preferably $C_{10-16}$, particularly preferably $C_{10-14}$ linear alkyl or alkenyl group; $R^{34}$ and $R^{35}$ represent a $C_{1-3}$ alkyl group or a $C_{1-3}$ hydroxyalkyl group; $R^{33}$ represents a $C_{1-5}$, preferably $C_2$ or $C_3$, alkylene group; A is a group selected from —COO—, —CONH—, —OCO—, —NHCO— and —O—; and a is an integer of 0 or 1, preferably 1.

(9)

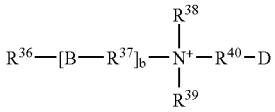

wherein $R^{36}$ represents a $C_{9-23}$, preferably $C_{9-17}$, particularly preferably $C_{10-16}$ alkyl or alkenyl group; $R^{37}$ represents a $C_{1-6}$, preferably $C_{1-4}$, particularly preferably $C_2$ or $C_3$ alkylene group; B is a group selected from —COO—, —CONH—, —OCO—, —NHCO— and —O—; b is an integer of 0 or 1, preferably 0; $R^{38}$ and $R^{39}$ each represent a $C_{1-3}$ alkyl group or a $C_{1-3}$ hydroxyalkyl group, preferably a methyl group, an ethyl group or a hydroxyethyl group; $R^{40}$ represents a $C_{1-5}$, preferably $C_{1-3}$, alkylene group which may be substituted with a hydroxy group; D is a group selected from $—COO^-$, $—SO_3^-$, and $—OSO_3^-$, among which $—OSO_3^-$ is preferable to regulate viscosity as desired or $—COO^-$ is preferable in respect of the ability to foam.

The surfactant in this invention is preferably a nonionic surfactant and/or cationic surfactant in respect of the antifouling effect, particularly preferably a nonionic surfactant selected from the compounds of the formula (3) and the compounds of the formula (4) and a cationic surfactant selected from the compounds of the formula (5), and particularly a cationic surfactant selected from the compounds of the formula (5) is preferably incorporated as an essential ingredient.

To confer the ability to foam in improving adhesion and a feel of the detergent effect during use, the surfactant is preferably a nonionic surfactant and amphoteric surfactant, particularly preferably a nonionic surfactant selected from the compounds of the formula (3) and the compounds of the formula (4) and an amphoteric surfactant selected from the compounds of the formula (8) and the compounds of the formula (9), still more preferably a nonionic surfactant selected from the compounds of the formula (4) and an amphoteric surfactant selected from the compounds of the formula (9).

The component (b) is contained in an amount of preferably 0.001 to 50 mass-%, more preferably 0.005 to 30 mass-%, still more preferably 0.01 to 25 mass-%, in the antifouling detergent for hard surfaces in this invention, and when the hard surface of an object is cleaned by a spraying method of using a spray device such as a trigger or an aerosol or by a applying method, the concentration of the component (b) is 0.001 to 10 mass-%, more preferably 0.005 to 5 mass-%, still more preferably 0.01 to 3 mass-%, while if an automatic toilet bowl cleaner that can feed a suitable amount of a detergent to water in a toilet tank by arranging the device in the tank or in an arbitrary water-feeding passage is used in a method of washing with water in a toilet tank, the component (b) is contained in an amount of 0.1 to 50 mass-%, more preferably 1 to 30 mass-%, still more preferably 5 to 25 mass-%. The concentration of the component (b) in the toilet tank is preferably 0.01 to 20 ppm, more preferably 0.1 to 10 ppm.

Because the antifouling effect may be lowered when an anionic surfactant is used as the component (b) in this invention, it is preferable for the antifouling effect that the content of the anionic surfactant is 75 mass-% or less, preferably 50 mass-% or less, particularly preferably 30 mass-% or less, relative to the total amount of the component (b). In particular, when the cationic surfactant and anionic surfactant represented by the formulae (5) to (7) are simultaneously used, the ratio of the anionic surfactant to the cationic surfactant ratio by mass is less than 1, particularly preferably less than 0.75.

In this invention, a water-soluble solvent [hereinafter referred to as component (c)] is incorporated preferably as an arbitrary component for the purpose of improving detergency against organic soils and stability during storage, and the component (c) is preferably at least one member selected from [1] a $C_{1-5}$ monovalent alcohol, [2] a $C_{4-12}$ polyvalent alcohol, [3] a compound represented by the formula (12) below, [4] a compound represented by the formula (13) below, and [5] a compound represented by the formula (14) below.

$$R^{41}O(C_2H_4O)_m(C_3H_6O)_nR^{42} \quad (12)$$

(13)

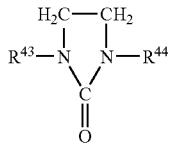

$$R^{45}OCH_2CH(OH)CH_2OH \quad (14)$$

wherein $R^{41}$ and $R^{42}$ each represent a hydrogen atom, a $C_{1-8}$ alkyl group, a phenyl group or a benzyl group, provided that $R^{41}$ and $R^{42}$ are not simultaneously hydrogen atoms; m is the number of 0 to 10 on the average, and n is the number of 0 to 10 on the average, provided that m and n are not simultaneously 0; $R^{43}$ and $R^{44}$ represent a $C_{1-3}$ alkyl group; and $R^{45}$ represents a $C_{1-8}$ alkyl group.

Generally, the $C_{2-5}$, monovalent alcohol [1] includes ethanol, propyl alcohol and isopropyl alcohol and the like. These lower alcohols can be compounded to further improve the stability of the system at low temperatures.

The $C_{4-12}$ polyvalent alcohol [2] includes isoprene glycol, 2,2,4-trimethyl-1,3-pentanediol,1,4-butanediol, 1,5-pentanediol, 1,8-octanediol, 1,9-nonanediol, ethylene glycol, propylene glycol, diethylene glycol, dipropylene glycol and glycerin, as well as monoalkyl glyceryl ethers having $C_{3-8}$ alkyl groups and the like.

The number of carbon atoms in the compound [3] represented by the formula (12) in case that $R^{41}$ and $R^{42}$ represent an alkyl group is particularly preferably 1 to 4. In the formula (12), the average numbers (m and n) of EO and PO molecules added are each the number of 0 to 10 on the average, and the order of addition of EO and PO is not particularly limited, and these units may be added randomly. Examples of the compound [3] include ethylene glycol monobutyl ether, dipropylene glycol dimethyl ether, diethylene glycol monoethyl ether, diethylene glycol monobutyl ether, propylene glycol monomethyl ether, propylene glycol monopropyl ether, propylene glycol monobutyl ether, propylene glycol monoethyl ether, propylene glycol dimethyl ether, polyoxyethylene(average number of molecules added=2 to 3) polyoxypropylene (average number of molecules added=2 to 3) glycol dimethyl ether, polyoxyethylene (average number of molecules added=1 to 4) glycol phenyl ether, phenyl carbitol, phenyl cellosolve, benzyl carbitol, etc. Among these, propylene glycol monomethyl ether, diethylene glycol monobutyl ether and polyoxyethylene(average number of molecules added=1 to 4) glycol phenyl ether are preferable in respect of detergency and a availability.

Preferable examples of the compound [4] include 1,3-dimethyl-2-imidazolidinone and 1,3-diethyl-2-imidazolidinone, and the compound [5] includes 3-methoxy-3-methyl butanol, 3-ethoxy-3-methyl butanol, etc.

Among those described above, a water-soluble solvent selected from the compounds [1], [2] and [3] is preferable in respect of harmless to a base material such as plastics and rubber, and this solvent is particularly preferably a water-soluble solvent selected from ethanol, isopropyl alcohol, ethylene glycol, propylene glycol, diethylene glycol, dipropylene glycol, glycerin, isoprene glycol, propylene glycol monomethyl ether, propylene glycol monoethyl ether, 1,4-butanediol, 1,5-pentanediol, propylene glycol monopropyl ether, propylene glycol monobutyl ether, and a monoalkyl glyceryl ether having a $C_{3-8}$ alkyl group, more preferably a water-soluble solvent selected from ethanol, ethylene glycol, propylene glycol, diethylene glycol, dipropylene glycol, glycerin, isoprene glycol, 1,4-butanediol, 1,5-pentanediol, propylene glycol monomethyl ether, pentyl glyceryl ether, and octyl glyceryl ether.

The component (c) is contained in an amount of preferably 0.1 to 50 mass-%, more preferably 0.5 to 30 mass-%, in the antifouling detergent for hard surfaces in this invention, and when the hard surface of an object is cleaned by a spraying method of using a spray device such as a trigger or an aerosol or by a applying method, the concentration of the component (c) is 0.1 to 20 mass-%, more preferably 0.5 to 10 mass-%, particularly preferably 0.5 to 7 mass-%, while if an automatic toilet bowl cleaner that can feed a suitable amount of a detergent to water in a toilet tank by arranging the device in the tank or in an arbitrary water-feeding passage is used in a method of washing with water in a toilet tank, the component (c) is contained in an amount of 1 to 50 mass-%, more preferably 3 to 40 mass-%, still more preferably 5 to 30 mass-%. The concentration of the component (c) in the toilet tank is preferably 0.01 to 20 ppm, more preferably 0.1 to 10 ppm.

For the purpose of dissolving inorganic soils and improving detergency and further improving the antifouling effect in this invention, a chelating agent is incorporated preferably as component (d). The chelating agent includes (d1) tripolyphosphoric acid, pyrophosphoric acid, orthophosphoric acid, hexamethaphosphoric acid, and alkali metal salts thereof, (d2) ethylenediaminetetraacetic acid, hydroxyiminodiacetic acid, dihydroxyethyl glycine, nitrilotriacetic acid, hydroxyethylenediaminetriacetic acid, diethylenetriaminepentaacetic acid, triethylenetetraminehexaacetic acid, and alkali metal salts or alkaline earth metal salts thereof, (d3) aminotrimethylenephosphonic acid, 1-hydroxyethylidene-1,1-diphosphonic acid, ethylenediaminetetramethylenephosphonic acid, diethylenetriaminepentamethylenephosphonic acid, aminotrimethylenephosphonic acid, and alkali metal salts or alkaline earth metal salts thereof, (d4) homopolymers or copolymers of monomers selected from acrylic acid and methacrylic acid, acrylic acid-maleic acid copolymers, poly-α-hydroxyacrylic acid, and alkali metal salts thereof, (d5) one or more polyvalent carboxylic acids selected from citric acid, succinic acid, malic acid, fumaric acid, tartaric acid, malonic acid and maleic acid, and alkali metal salts thereof, (d6) alkylglycine-N,N-diacetic acid, aspartic acid-N,N-diacetic acid, serine-N,N-diacetic acid, glutamic acid diacetic acid, ethylenediaminedisuccinic acid or salts thereof, and particularly the compounds (d2), (d3) and (d5) are preferable.

The component (d) is contained in an amount of preferably 0.1 to 20 mass-% in the antifouling detergent for hard surfaces in this invention, and when the hard surface of an object is cleaned by a spraying method of using a spray device such as a trigger or an aerosol or by an applying method, the concentration of the component (d) is preferably 0.1 to 10 mass-%, more preferably 0.3 to 7 mass-%, while if an automatic toilet bowl cleaner that can feed a suitable amount of a detergent to water in a toilet tank by arranging the device in the tank or in an arbitrary water-feeding passage is used in a method of washing with water in a toilet tank, the component (d) is contained in an amount of preferably 0.1 to 20 mass-%, more preferably 0.1 to 10 mass-%. The concentration of the component (d) in the toilet tank is preferably 0.01 to 20 ppm.

For the purpose of improving storage stability and improving the ability to foam during use, a hydrotropic agent can be contained in the antifouling detergent for hard surfaces in this invention. Preferable compounds include benzenesulfonic acid whose $C_{1-3}$ alkyl group is substituted with 1 to 3 groups, and salts thereof. More preferable examples of the hydrotropic agent include p-toluenesulfonic acid, m-xylenesulfonic acid, p-cumenesulfonic acid and ethylbenzenesulfonic acid, and when salts thereof are used, sodium salts, potassium salts and magnesium salts are preferable. The content of these compounds in the antifouling detergent for hard surfaces in this invention is preferably 0.1 to 10 mass-%, more preferably 0.1 to 5 mass-%, particularly preferably 0.1 to 3 mass-%.

For the purpose of improving usability by conferring adhesion during use, one or more water-soluble polymers can be added in this invention. The water-soluble polymers are not particularly limited, but one or more water-soluble polymers selected from those described on page 6, column 10, to page 7, column 11 in JP-A 8-209194 are preferable.

Beside the components described above, additives incorporated into usual detergents, for example, perfumes, antimicrobial agents, viscosity regulating agents, pigments, dyes and suspending agents can be added to the antifouling detergent for hard surfaces in this invention in such a range that the effect of this invention is not deteriorated.

When the detergent of the invention is used, the polymer as the component (a) in the form of one agent or arbitrarily divided agents combined with an arbitrary component may be dissolved or dispersed in a solvent. By combining it with an arbitrary component, the detergent of the invention can be used in the form of one or more agents as powders or tablets dissolved immediately in a solvent such as water or endowed with sustained releasability. Further, the detergent of the invention can be used in such a form that one of the component (a) and the arbitrary component is liquid, and the other is solid such as powder.

The antifouling detergent for hard surfaces in this invention is preferably a liquid antifouling detergent comprising the component (a) and an arbitrary component, the balance being water, and when used as an automatic toilet bowl cleaner, the detergent may be solidified or gelled by using a coagulating agent such as polyethylene glycol, polyethylene glycol fatty ester, polyethylene glycol fatty diester, a fatty acid or a salt. The content of water in the liquid antifouling detergent or the gelled antifouling detergent is preferably 10 to 99.99 mass-%, more preferably 20 to 98 mass-%. The content of water in the solid antifouling detergent is preferably 30 mass-% or less, more preferably 20 mass-% or less.

When the antifouling detergent for hard surfaces in this invention is used, its form is not particularly limited, but it is preferable to use <1> a method of spraying an object directly with the antifouling detergent by a sprayer such as a trigger or an aerosol, <2> a method of rubbing an object with a water-absorbing flexible material impregnated with the antifouling detergent, and <3> a method of dipping an object in a solution having the antifouling detergent dissolved therein.

In the method <1>, a trigger spray is preferable, and particularly a pressure-accumulating trigger free of sags and excellent in spray uniformity, as shown in FIG. 1 in Japanese Utility Model Application Laid-Open (JP-U) No. 4-37554, is preferably used, and the antifouling detergent is sprayed in a ratio of preferably 0.2-10 g to 100-800 $cm^2$ surface of an object. For spraying, the viscosity of the solution is 1-200 mPa·s, preferably 2-100 mPa·s.

In the method <2>, a cloth, a nonwoven fabric or a sponge can be used as the water-absorbing flexible material, and particularly a sponge is used in respect of the effect on removal of fouling.

In the method <3>, it is preferred that an object is dipped in a solution prepared by diluting the conc. liquid antifouling detergent or dissolving the solid antifouling detergent. In this dipping, an object is dipped completely in the solution optionally under suitable stirring. The dipping time is 0.5 to 300 minutes, preferably 2 to 150 minutes.

The detergent of this invention is used most preferably as a detergent for use in a toilet bowl, including detergents of automatic toilet bowl cleaner type and spray or applying type. Preferable compositions are shown below.

The polymer used as the antifouling detergent for hard surfaces in this invention is a copolymer with a weight-average molecular weight of 5,000 to 60,000, comprising the monomer unit A of the formula (1) and the monomer unit B selected from the above-described (i), (ii) and (v) wherein the molar ratio of monomer unit A/(monomer unit A+monomer unit B) is 0.5 to 0.9.

<Automatic Toilet Bowl Cleaner> which is preferably in a gel or liquid form, comprising:

(A) the polymer described above, 4 to 15% by mass, (B) a surfactant (provided that the cationic surfactant of the formula (5) is blended as an essential component), 2 to 25% by mass, (C) a water-soluble solvent (the compound of the formula (12), the compound of the formula (14), ethanol, ethylene glycol, glycerin, propylene glycol, etc.), 5 to 30% by mass, (D) a chelating agent (citric acid, ethylenediamine tetraacetic acid(hereinafter EDTA) etc.), 0.1 to 10% by mass, (E) water, which is the balance, (F) arbitrary components (hydrotropic agent, coagulating agent, and other additives).

<Toilet Spray or Applying Detergent> which is preferably a liquid detergent, comprising:

(A') the polymer described above, 0.05 to 2% by mass, (B') a surfactant (provided that the cationic surfactant of the formula (5) is blended as an essential component), 0.01 to 3% by mass, (C') a water-soluble solvent (the compound of the formula (12), the compound of the formula (14), ethanol, ethylene glycol, glycerin, propylene glycol, etc.), 0.5 to 30% by mass, (D') a chelating agent (citric acid, EDTA, etc.), 0.1 to 10% by mass, (E') water, which is the balance, (F') arbitrary components (hydrotropic agent, coagulating agent, and other additives).

EXAMPLES

Example 1

5 g of antifouling detergent for hard surfaces with the composition shown in Table 1 was applied uniformly to the inside of a home toilet bowl every time the toilet was used, and the portion of the toilet bowl not storing water (hereinafter referred to as front region), the border of the water-storing portion (hereinafter referred to as water-line region), and the water-storing portion (referred to hereinafter as water-sealed region) were observed for fouling after 2 months and 4 months, and evaluated according to the following criteria for antifouling effect (antifouling performance). The results are shown in Table 1.

(Evaluation Criteria)

◎: Not fouled

○: Fouled slightly

Δ: Fouled a little x: Fouled considerably

TABLE 1

| | | | Present invention products | | | | | | |
|---|---|---|---|---|---|---|---|---|---|
| | | | 1-1 | 1-2 | 1-3 | 1-4 | 1-5 | 1-6 | 1-7 |
| Component (mass %) | PolymerA | | 0.5 | 0.5 | 0.5 | 0.5 | — | — | — |
| | Polymer B | | — | — | — | — | 0.02 | 0.2 | 1.0 |
| | Polymer C | | — | — | — | — | — | — | — |
| | Polymer D | | — | — | — | — | — | — | — |
| | Polymer E | | — | — | — | — | — | — | — |
| | Surfactant A | | — | 0.05 | — | — | — | — | — |
| | Surfactant B | | — | — | 0.05 | — | — | — | — |
| | Surfactant C | | — | — | — | 0.05 | 0.05 | 0.05 | 0.05 |
| | Surfactant D | | — | — | — | — | — | — | — |
| | Surfactant E | | — | — | 5.0 | — | — | — | — |
| | Surfactant F | | — | — | — | 3.0 | — | — | — |
| | Surfactant G | | — | — | — | — | — | — | — |
| | Ethanol | | — | 5.0 | 5.0 | 5.0 | 5.0 | 5.0 | 5.0 |
| | EDTA-4Na | | — | — | — | — | — | — | — |
| | Citric acid | | — | — | — | — | — | — | — |
| | Water | | Balance | Balance | Balance | Balance | Balance | Balance | Balance |
| | Total | | 100 | 100 | 100 | 100 | 100 | 100 | 100 |
| | pH(20° C.) | | 6 | 8 | 8 | 8 | 7 | 7 | 7 |
| Antifouling performance | After 2 months | front region | ○ | ○ | ◎ | ◎ | Δ | ○ | ◎ |
| | | water-line region | ○ | ◎ | ◎ | ◎ | ○ | ◎ | ◎ |
| | | water-sealed region | ◎ | ◎ | ◎ | ◎ | ◎ | ◎ | ◎ |
| | After 4 months | front region | ○ | ○ | ○ | ○ | ○ | ○ | ○ |
| | | water-line region | Δ | ○ | ○ | ○ | ○ | ○ | ○ |
| | | water-sealed region | ○ | ◎ | ◎ | ◎ | ○ | ◎ | ◎ |

TABLE 1-continued

| | | | Present invention products | | | Comparative products | | | |
|---|---|---|---|---|---|---|---|---|---|
| | | | 1-8 | 1-9 | 1-10 | 1-1 | 1-2 | 1-3 | 1-4 |
| Component (mass %) | PolymerA | | — | — | — | — | — | — | — |
| | Polymer B | | 0.5 | 0.5 | 0.5 | — | — | — | — |
| | Polymer C | | — | — | — | 0.5 | — | — | — |
| | Polymer D | | — | — | — | — | 0.5 | — | — |
| | Polymer E | | — | — | — | — | — | 0.5 | — |
| | Surfactant A | | — | — | — | — | — | — | — |
| | Surfactant B | | — | — | — | — | — | — | — |
| | Surfactant C | | — | — | — | — | — | — | 0.05 |
| | Surfactant D | | 0.5 | — | — | — | — | — | — |
| | Surfactant E | | 1.0 | — | 2.0 | — | — | — | — |
| | Surfactant F | | — | 5.0 | — | — | — | — | — |
| | Surfactant G | | 2.0 | — | 3.0 | — | — | — | — |
| | Ethanol | | 5.0 | 5.0 | 5.0 | — | — | — | 5.0 |
| | EDTA-4Na | | 5.0 | — | 2.0 | — | — | — | — |
| | Citric acid | | — | 5.0 | 3.0 | — | — | — | — |
| | Water | | Balance | Balance | Balance | Balance | Balance | Balance | Balance |
| | Total | | 100 | 100 | 100 | 100 | 100 | 100 | 100 |
| | pH(20° C.) | | 7 | 6 | 6 | 7 | 7 | 7 | 7 |
| Antifouling performance | After 2 months | front region | ◎ | ◎ | ◎ | ○ | ○ | ○ | X |
| | | water-line region | ◎ | ◎ | ◎ | ○ | ○ | ○ | Δ |
| | | water-sealed region | ◎ | ◎ | ◎ | ○ | Δ | Δ | ○ |
| | After 4 months | front region | ◎ | ◎ | ◎ | ○ | ○ | ○ | X |
| | | water-line region | ◎ | ○ | ○ | Δ | Δ | Δ | Δ |
| | | water-sealed region | ◎ | ◎ | ◎ | X | X | X | Δ |

The components in Table 1 are as follows:

Polymer A: diallyldimethylammonium chloride/maleic acid (molar ratio 2/1) copolymer, a weight-average molecular weight of 60,000

Polymer B: diallyldimethylammonium chloride/maleic acid/sulfur dioxide (molar ratio 2/1/1) copolymer, a weight-average molecular weight of 30,000

Polymer C: Merquat 280 manufactured by Calgon, that is, diallyldimethylammonium chloride/acrylic acid (molar ratio 64/36) copolymer, a weight-average molecular weight of 1,700,000

Polymer D: Merquat 100 manufactured by Calgon, that is, diallyldimethylammonium chloride polymer, a weight-average molecular weight of 500,000

Polymer E: Merquat 550 manufactured by Calgon, that is, diallyldimethylammonium chloride/acrylamide (molar ratio 30/70) copolymer, a weight-average molecular weight of 5,000,000

Surfactant A: Benzethonium chloride

Surfactant B: Didecyldimethylammonium chloride

Surfactant C: Cocoalkyldimethyl benzylammonium chloride

Surfactant D: Octyldimethyl benzylammonium chloride

Surfactant E: Alkyl glycosid (whose linear alkyl group contains 12 or 14 carbon atoms, average degree of condensation of the sugar(glucose)=1.2 [degree of condensation of the sugar(glucose)=1 or 2].

Surfactant F: dodecyldimethylamine oxide

Surfactant G: N-lauroylaminopropyl-N,N-dimethyl-N-carboxymethylammonium betaine

EDTA-4Na: Tetrasodium ethylenediaminetetraacetate

The pH value was adjusted with an aqueous hydrochloric acid solution and/or an aqueous sodium hydroxide solution.

Example 2

A concentrate containing the components shown in Table 2 was introduced into a toilet tank such that a solution with the composition shown in Table 2 was flushed, and the toilet bowl was used as usually in a home. The antifouling effect (antifouling performance) after 2 months was evaluated in the same manner as in Example 1. The results are shown in Table 2. The components in Table 2 are the same as in Table 1.

TABLE 2

| | | Present invention products | | | | | | | | Comaparative products | | | |
|---|---|---|---|---|---|---|---|---|---|---|---|---|---|
| | | 2-1 | 2-2 | 2-3 | 2-4 | 2-5 | 2-6 | 2-7 | 2-8 | 2-1 | 2-2 | 2-3 | 2-4 |
| Concentration of flowing liquid (ppm) | PolymerA | 1.0 | 1.0 | 1.0 | 1.0 | — | — | — | — | — | — | — | — |
| | PolymerB | — | — | — | — | 0.2 | 1.0 | 5.0 | 2.0 | — | — | — | — |
| | PolymerC | — | — | — | — | — | — | — | — | — | 0.5 | — | — |
| | PolymerD | — | — | — | — | — | — | — | — | — | — | 0.5 | — |
| | PolymerE | — | — | — | — | — | — | — | — | — | — | — | 0.5 |

TABLE 2-continued

| | | | Present invention products | | | | | | | | Comaparative products | | | |
|---|---|---|---|---|---|---|---|---|---|---|---|---|---|---|
| | | | 2-1 | 2-2 | 2-3 | 2-4 | 2-5 | 2-6 | 2-7 | 2-8 | 2-1 | 2-2 | 2-3 | 2-4 |
| | Surfactant A | | — | 1.0 | — | — | — | — | — | — | — | — | — | — |
| | Surfactant B | | — | — | 1.0 | — | — | — | — | — | — | — | — | — |
| | Surfactant C | | — | — | — | 1.0 | 0.5 | 0.5 | 0.5 | 1.0 | — | — | — | — |
| | Surfactant E | | — | — | 5.0 | — | — | — | — | 3.0 | — | — | — | — |
| | Ethylene glycol | | 3.0 | 3.0 | 3.0 | 3.0 | 3.0 | 3.0 | 3.0 | 3.0 | 3.0 | 3.0 | 3.0 | 3.0 |
| Antifouling performance | After 2 months | front region | ○ | ○ | ◎ | ◎ | Δ | ◎ | ◎ | ◎ | X | ○ | Δ | ○ |
| | | water-line region | ○ | ◎ | ◎ | ◎ | ◎ | ◎ | ◎ | ◎ | X | Δ | Δ | Δ |
| | | water-sealed region | ◎ | ◎ | ◎ | ◎ | ◎ | ◎ | ◎ | ◎ | Δ | X | X | X |

The invention claimed is:

1. A method of antifouling and washing hard surfaces of toilet bowls, comprising:

treating the surfaces with an antifouling detergent composition comprising a polymer having a weight-average molecular weight of 5,000 to 60,000 and consisting essentially of monomer unit A and monomer unit B, wherein the molar ratio of monomer unit A/[monomer unit A+ monomer unit B] is ⅔ to 0.9 wherein the monomer unit A is di (ω-alkenyl ($C_2$-$C_{10}$)-dialkyl ($C_1$-$C_3$) ammonium salt in an amount of 10 to 90 mol-% relative to the whole monomer units, the monomer B is at least one monomer derived from a monomer selected from acrylic acid or salts thereof, methacrylic acid or salts thereof, and maleic acid or salts thereof.

2. The method according to claim 1, wherein the antifouling detergent composition further comprises a surfactant.

3. The method according to claim 2, wherein an amount of the surfactant is 0.00 1 to 50 mass-%.

4. The method according to claim 1, wherein the antifouling detergent composition further comprises a water-soluble solvent.

5. The method according to claim 4, wherein an amount of the water-soluble solvent is 0.1 to 50 mass-%.

* * * * *